United States Patent [19]

Dunlop

[11] 4,158,296

[45] Jun. 19, 1979

[54] HAND-KNITTING METHOD

[76] Inventor: Thomas A. Dunlop, 16 N. Park Ave., Girvan, Ayrshire, KA26 9AH, England

[21] Appl. No.: 791,728

[22] Filed: Apr. 28, 1977

[30] Foreign Application Priority Data

May 4, 1976 [GB] United Kingdom ..... 18108/76

[51] Int. Cl.[2] ..... D04B 3/00

[52] U.S. Cl. ..... 66/4

[58] Field of Search ..... 66/1 A, 4

[56] References Cited

U.S. PATENT DOCUMENTS

| | | | |
|---|---|---|---|
| 1,318,604 | 10/1919 | Schneider | 66/4 |
| 1,500,383 | 7/1924 | Gourie | 66/4 |
| 1,694,849 | 12/1928 | Fuji | 66/4 |
| 1,776,561 | 9/1930 | Croix | 66/4 |
| 2,072,668 | 3/1937 | Eltgroth | 66/4 |
| 2,134,066 | 10/1938 | Van Ness | 66/4 |
| 2,237,733 | 4/1941 | Grimm et al. | 66/4 |
| 2,609,676 | 9/1952 | Woroneski | 66/4 |
| 2,703,482 | 3/1955 | Auran | 66/4 |
| 3,678,709 | 7/1972 | Nowicki et al. | 66/4 |
| 3,967,467 | 7/1976 | Leach, Sr. | 66/4 |

FOREIGN PATENT DOCUMENTS

| | | | |
|---|---|---|---|
| 555915 | 9/1973 | Switzerland | 66/4 |
| 570244 | 6/1945 | United Kingdom | 66/4 |

*Primary Examiner*—Werner H. Schroeder
*Assistant Examiner*—Andrew M. Falik
*Attorney, Agent, or Firm*—Auslander & Thomas

[57] ABSTRACT

A hobby craft kit of a slotted board and pins has center line pins at slot ends for the hand knitting of articles.

3 Claims, 6 Drawing Figures

FIG.5
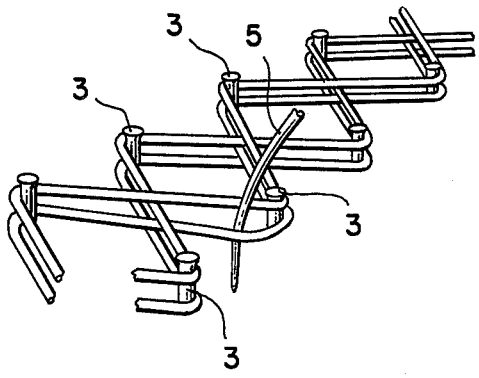
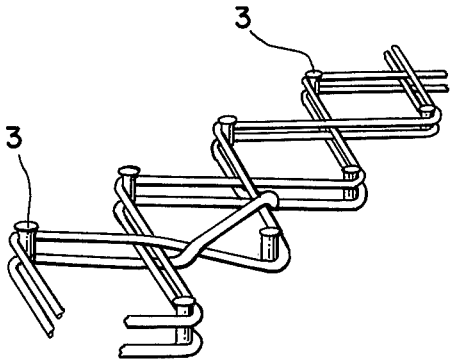
FIG.6

HAND-KNITTING METHOD

This invention relates to hobbycraft kits and particularly to such kits for use in making knitted articles. By hobbycraft kits is meant kits for use by relatively unskilled people, which kits assist them in making, as a hobby or pastime, articles which would normally require a skill to produce. Such kits are extensively used by children, invalids and mentally-handicapped people.

According to the present invention there is provided a hobbycraft kit comprising a board, a longitudinal slot in the board, a plurality of pins secured to the board and equi-spaced along both sides of said slot and one of said pins being provided at each end of said slot and on the centre line thereof, and a stitch lifter adapted, in use, to lift stitches over said pins.

Preferably, said pins are spaced approximately ⅜" from each other and extend ¼" perpendicularly above the surface of the board. The board may be formed from wood into which the pins are inserted or alternatively the board and the pins may be moulded integrally from plastics material.

An embodiment of the present invention will now be described, by way of example, with reference to the accompanying drawings, in which:

FIG. 5 is a perspective of two strands of yarn wound on pins with a lifter inserted.

FIG. 6 is a perspective of FIG. 5 showing a stitch completed by the lifter.

Figure 1:
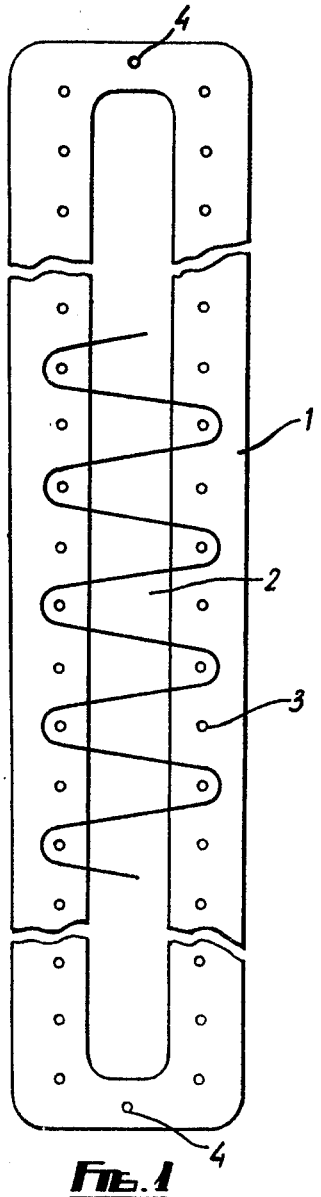
FIG. 1 is a plan view of a kit according to the invention and partially showing the arrangement of yarn on the pins to produce a knitted article.

Referring now to the drawings a hobbycraft kit for producing knitted articles comprises a board 1 having a slot 2 extending longitudinally thereof. A number of pins 3 are secured to the board and are equi-spaced along both sides of the slot with one pin 4 being provided at each end of the slot on the centre line thereof. Each pin is spaced roughly ⅜" from adjacent pins and has a height of around ¼". In the sample shown the board is formed from wood and the pins from nails driven into the wood. In the embodiments shown in FIGS. 1 and 2 the pins are in a single line along each side of the slot. However, in the modified arrangement shown in FIGS. 3 and 4 a double line is formed for ease of use.

Figure 2:
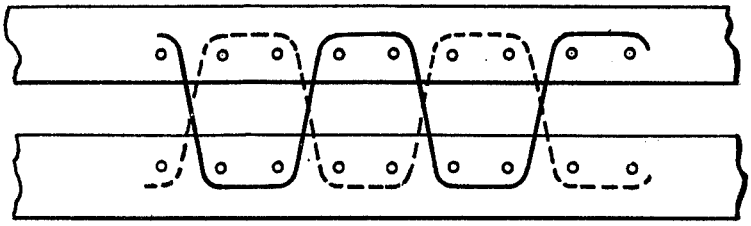
FIG. 2 shows a partial view of an alternative arrangement of yarn on the pins so as to produce a different pattern.
Figure 3:
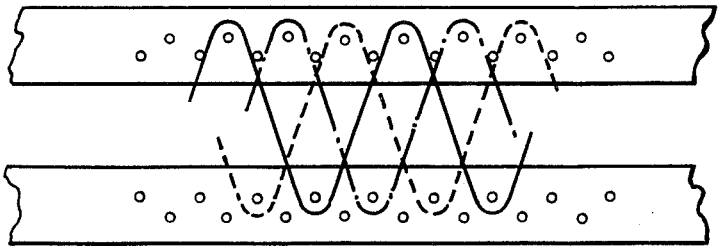
FIG. 3 is a partial view of a modified arrangement of pins and using three different colours of yarn to form a design.

A stitch lifter in the form of a needle is provided and yarn is then wound around the pins in any desired manner so as to form a suitable pattern. After the first row of yarn has been wound around the pins the yarn is passed around one of the end pins 4 and wound around either the same or different pins moving in the direction of the other end pin 4. As a piece of yarn is wound on to a pin which already has yarn wound around it the stitch lifter is inserted under the existing stitch as the new stitch is laid over the pin so that the existing stitch can be lifted off the pin over the new stitch. If this process is continued, moving from one end pin to the other, the stitches lifted off the pins form a knitted material having a pattern thereof corresponding to the pattern initially laid on to the pins. The pattern can be changed during knitting and more than one yarn of the same or different colors may be used (as shown in FIGS. 2 and 3) so as to increase the patterns available. In FIG. 1 the pattern comprises laying the yarn over every alternate pin on each side in a chevron pattern and this will produce a knitted fabric similar to that produced by ordinary plain and purl knitting.

In FIG. 2, two continuous strands of yarn are used of different colors and the pattern laid along the pins has been changed along the length of the slot so as to produce a multi-coloured patterned knitted fabric.

In FIG. 3, three continuous strands of yarn of different colors are used and laid alternately over inner and outer pins on the first pass and vice versa on the return pass.

Figure 4:
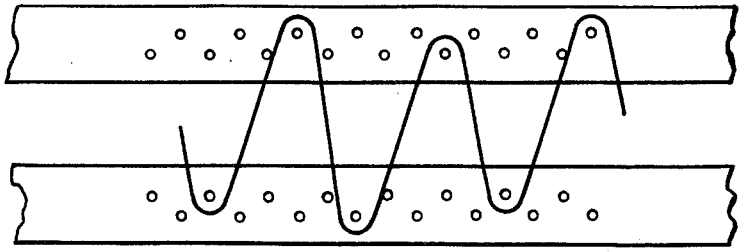
FIG. 4 is a view corresponding to FIG. 3 showing an alternative arrangement of yarn in the pins so as to produce a different pattern.

In FIG. 4, a single strand of yarn is passed over two inner then two outer pins to form a further pattern.

In FIGS. 5 and 6 are shown the steps in knitting a stitch where the strands of yarn are wound around the pins 3 and a lifter 5 lifts the lower strand over the pin to complete the stitch as shown in FIG. 6.

Clearly, an infinite variety of patterns are available.

What I claim is:

1. A method of producing a flat-knitted article with finished edges comprising the steps of winding a first row of a yarn around the pins of a board, said board including a longitudinal slot; a plurality of said pins secured to said board and equi-spaced along both sides of said slot; and additional pins one at each of the ends of said slots; each said additional pin on the centerline of said slot, winding said yarn around one of said additional pins, then winding said yarn in the direction of said other additional pin, and after said yarn is wound over an existing winding of yarn, lifting said existing winding of yarn over each said pin leaving a winding of yarn wound around each pin, and repeating said winding and lifting until an optional size article has been knitted.

2. The method of claim 1 in which the pins on said board are spaced approximately three eigths inch from each other and extend approximately one quarter inch perpendicularly from the surface of the board.

3. The method of claim 1 in which two parallel rows of pins are provided on each side of said slot.

* * * * *